US010035965B2

(12) United States Patent
De Bellis

(10) Patent No.: US 10,035,965 B2
(45) Date of Patent: Jul. 31, 2018

(54) METHOD FOR PRODUCING SYNGAS FROM CARBON BASED MATERIAL

(71) Applicant: High Tech Energie SRO, Levice (SK)

(72) Inventor: Michele De Bellis, Milan (IT)

(73) Assignee: HIGH TECH ENERGIE SRO, Levice (SK)

( * ) Notice: Subject to any disclaimer, the term of this patent is extended or adjusted under 35 U.S.C. 154(b) by 101 days.

(21) Appl. No.: 15/333,264

(22) Filed: Oct. 25, 2016

(65) Prior Publication Data

US 2017/0037329 A1 Feb. 9, 2017

Related U.S. Application Data

(62) Division of application No. 13/978,269, filed as application No. PCT/EP2011/073453 on Dec. 20, 2011, now abandoned.

(30) Foreign Application Priority Data

Jan. 5, 2011 (IT) ..... BG2011A0001

(51) Int. Cl.
*C10J 3/66* (2006.01)
*C10B 21/10* (2006.01)
(Continued)

(52) U.S. Cl.
CPC ..... *C10J 3/66* (2013.01); *C10B 21/10* (2013.01); *C10J 3/04* (2013.01); *C10J 3/723* (2013.01);
(Continued)

(58) Field of Classification Search
CPC combination set(s) only.
See application file for complete search history.

(56) References Cited

U.S. PATENT DOCUMENTS 3,840,354 A * 10/1974 Donath ..... C07C 1/02 48/202
3,991,557 A * 11/1976 Donath ..... C10J 3/46 201/17
(Continued)

FOREIGN PATENT DOCUMENTS

FR 2863920 A1 6/2005
GB 837074 A 6/1960
(Continued)

*Primary Examiner* — Kaity Chandler
(74) *Attorney, Agent, or Firm* — Polsinelli PC

(57) ABSTRACT

"Syngas" is produced from carbon based material in a system comprising means for feeding material into the system, means for combustion thereof, means for use of Syngas and means for extraction of combustion residues, combustion means comprise: a sealed combustion chamber; device for injection of gas into the combustion chamber; device for monitoring the quantity of gas introduced/to be introduced into the combustion chamber, where the method comprises: introducing the material into a combustion chamber, wherein the combustion chamber has a constant temperature between 300 and 600° C.; residence of the material therein for 5-13 hours; which allows combustion to decompose organic molecules of the material producing Syngas, continuously drawn off, and carbonous residues; residence of the carbonous residues at the temperature for 7-13 hours with excess air; the excess air for completely incinerating the carbonous residue; and use of the Syngas and extraction of the ash produced by the above.

10 Claims, 1 Drawing Sheet

(51) Int. Cl.
*C10J 3/72* (2006.01)
*C10J 3/04* (2006.01)

(52) U.S. Cl.
CPC ..... *C10J 2300/0916* (2013.01); *C10J 2300/0956* (2013.01); *C10J 2300/0959* (2013.01); *C10J 2300/1606* (2013.01); *C10J 2300/1675* (2013.01)

(56) References Cited

U.S. PATENT DOCUMENTS 4,039,392 A 8/1977 Singh
4,077,778 A * 3/1978 Nahas ..... C10J 3/482 48/202
4,193,771 A * 3/1980 Sharp ..... C10J 3/06 208/427
4,322,222 A * 3/1982 Sass ..... C10J 1/207 201/12
4,617,107 A 10/1986 Mandelson et al.
4,983,278 A 1/1991 Cha et al.
2007/0214719 A1* 9/2007 Yoshikawa ..... C10J 3/463 48/61
2009/0206007 A1* 8/2009 Allam ..... B01F 5/0659 208/415
2009/0209799 A1 8/2009 Etter et al.
2010/0051875 A1* 3/2010 Chornet ..... C01B 3/38 252/373
2010/0275514 A1 11/2010 Paganessi et al.
2010/0294179 A1 11/2010 Broglio et al.
2011/0036014 A1* 2/2011 Tsangaris ..... C01B 3/22 48/62 R
2011/0146155 A1* 6/2011 Bentzen ..... C10J 3/34 48/89
2013/0137154 A1* 5/2013 Reep ..... C10L 1/02 435/168

FOREIGN PATENT DOCUMENTS

WO WO-2005/066315 7/2005
WO WO-2010/104732 A2 9/2010

* cited by examiner

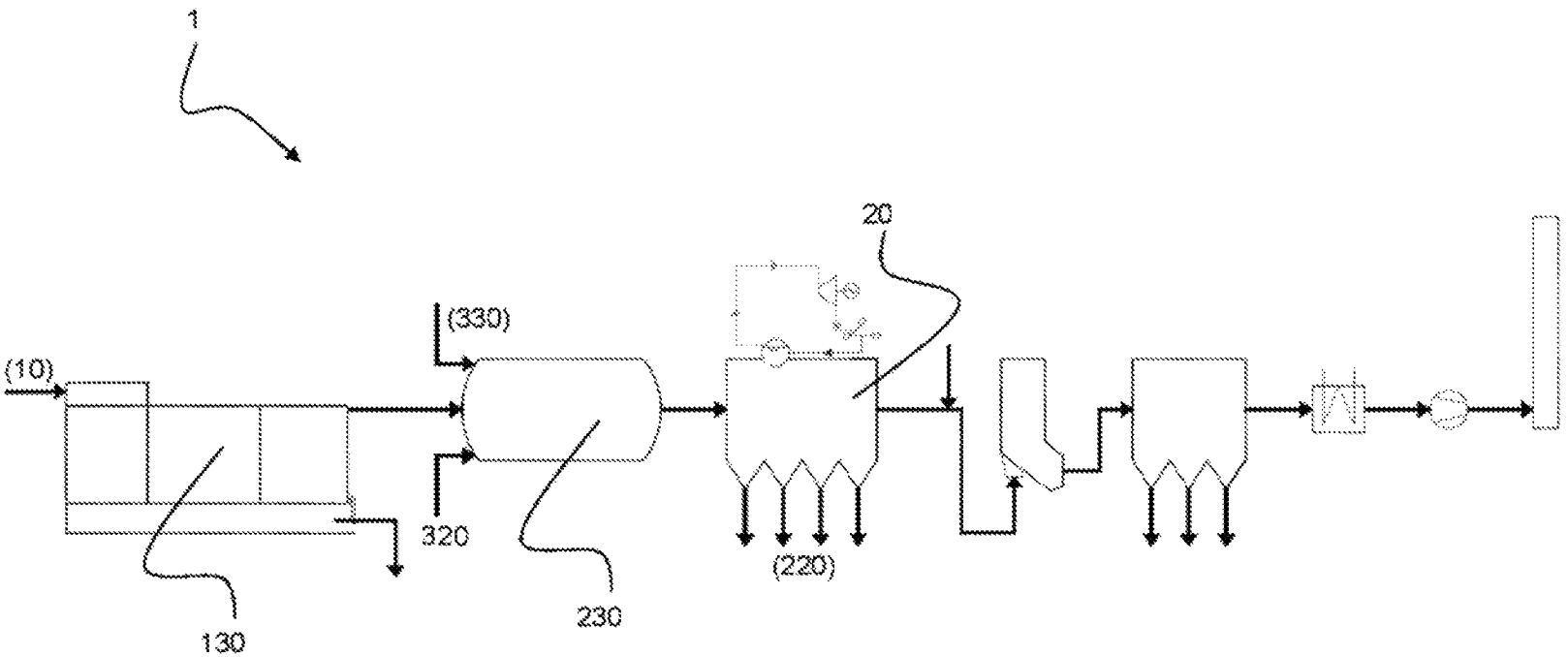
1
(10)
130
(330)
320
230
20
(220)

METHOD FOR PRODUCING SYNGAS FROM CARBON BASED MATERIAL

CROSS REFERENCE TO RELATED APPLICATIONS

This application is a Divisional Application of Ser. No. 13/978,269, filed Jul. 3, 2013, and now abandoned, which in turn is a National Phase filing under 35 U.S.C. § 371 of PCT/EP2011/073453 filed on Dec. 20, 2011; and this application claims priority to Application No. BG2011A000001 filed in Italy on Jan. 5, 2011 under 35 U.S.C. § 119; the entire contents of all are hereby incorporated by reference.

The present invention relates to a method for producing "Syngas" in a system for producing "Syngas". In particular, the present invention relates to the implementation of a method in a system for producing "Syngas" from carbon based material. Even more in particular, the present invention relates to a method for producing "Syngas" in a system for producing "Syngas" from carbon based material deriving from waste, whether unsorted or not.

TECHNICAL FIELD

The use of fossil fuels as energy carrier is widely known, to convey energy from one form to another, in particular using the energy contained therein to move vehicles and machinery, for heating and for other needs. These fossil fuels derive from the accumulation of solar energy, buried underground over the course of geological eras. Among these fuels, those most widely used are, in particular, oil and other hydrocarbons, coal, in all its forms, and natural gas.

BACKGROUND ART

Today, fossil fuels are the principal energy source exploited by humans, above all in relation to the noteworthy possibility of use for numerous purposes and to the usability thereof through simple machinery. These fossil fuels are also proving their shortcomings both in economic terms, in relation to the increasing complexity of extraction and reduction in usable reserves, and in environmental terms, in relation to the pollution they produce in order to release their energy.

Numerous types of alternative energy sources to fossil fuels are known, such as the so-called renewable energies. These are capable of producing energy by directly making use of solar radiation, wind power or the pressure of water resources.

A further alternative to the aforesaid energy sources is represented by technologies targeted at the use of carbon based materials to produce energy. These technologies transform organic material into "Syngas", through a molecular dissociation process, with a simple and modular approach to the problem of waste disposal and of its subsequent transformation into energy. Syngas, or synthesis gas, is a mixture of gases, essentially carbon monoxide (CO) and hydrogen ($H_2$), also with the presence of methane ($CH_4$) and carbon dioxide ($CO_2$) in variable quantities. Technologies such as those for the production of Syngas are therefore capable of transforming the organic material into an excellent energy carrier, greatly reducing, and even eliminating, the environmental impact with respect to treatment of energy sources deriving from fossil fuels. Moreover, the availability of an energy carrier such as Syngas, characterized by high calorific power, allows transformation thereof into steam by means of a boiler and its subsequent use through turbines to produce electrical energy.

Organic substances are formed of complex molecules of carbon, hydrogen and further elements. Solar energy is concentrated in the bonds that form between carbon and hydrogen atoms, fixed through the plant photosynthesis process. Therefore, molecular dissociation produces a breakdown of the aforesaid organic molecules into simpler molecules, usually, as specified, carbon monoxide (CO), hydrogen ($H_2$) and methane ($CH_4$). The process for producing said Syngas takes place in a closed environment, at a temperature below 650° C. in the absence of oxygen. The Syngas thus generated can be used to obtain different forms of energy, including thermal energy, by combustion thereof in a boiler, to produce overheated steam for the production of electrical energy by means of a steam turbine or for direct injection in endothermic engines for the production of thermal and/or electrical energy, as occurs for the usual fossil fuels.

US20100275514 describes a system and a process capable of using the energy content of a Syngas produced from biomass material. The system and the process involve compacting of the biomass material and simultaneous introduction thereof into the entrance of a reactor tube, followed by heating of the compacted material in said reactor. The reactor temperature allows breakdown of the organic molecules forming the compacted biomass material, with the formation of ash and a fuel gas mixture, i.e. Syngas.

However, said system does not allow precise control of the breakdown process. Therefore, the formation of residues and ash is high, with loss of further developable Syngas potential. Furthermore, this system does not allow minimizing of the environmental impact, as incomplete transformation of the organic substances in Syngas produces polluting waste. Moreover, said system only allows the production of Syngas from material derived from biomass, i.e. previously subjected to other processes, adapted to eliminate the substances and the non-biomass materials.

SUMMARY OF DISCLOSURE

It would therefore be desirable to obtain a system and a method for producing Syngas from carbon based material capable of minimizing residues and ash deriving from the molecular decomposition process.

It would also be desirable to obtain a system and a method capable of treating materials deriving from waste of any type, comprising biomass materials. It would be desirable for these materials to be usable equally without costly and necessary preliminary filtering operations.

It would also be desirable for said system and method to allow correct control of the combustion process adapted to allow complete molecular breakdown.

The aim of the present invention is therefore to provide a system and a method for producing Syngas from carbon based material capable of controlling the combustion and breakdown parameters, including temperature, time and substances supplementary to the process. More in particular, the system and the method described allow the implementation of monitored combustion and breakdown, capable of maximizing the production of Syngas from decomposition of said incoming material. The system and the method according to the present invention have high of monitoring and control possibilities, while also having the ability to minimize the environmental impact from residues and ash.

A further object of the present invention is to make the system and the method proposed versatile, in such a manner as to be able to utilize them for the use of waste materials of any type, without it being necessary to filter the incoming materials.

The aforesaid objects are achieved by a system for producing "Syngas" from carbon based material comprising means for feeding the material into the system, means for combustion of the material, adapted to produce Syngas, means for use of the Syngas and means for extraction of the combustion residues, characterized in that the means for combustion of the material comprise:

- a sealed combustion chamber, with temperature between 300 and 600° C., capable of decomposing the organic molecules of the carbon based material into a mixture of gases and into ash;
- a device injecting gas into the combustion chamber;
- a device monitoring the quantity of gas introduced/to be introduced into the combustion chamber, capable of guaranteeing a correct sub-stoichiometric ratio for decomposition of the organic molecules.

In this way, the system is capable of producing Syngas, reducing to a minimum the quantity of non-decomposed incoming material. This reduction is guaranteed by the temperature of the combustion chamber, monitored through a monitoring device adapted to maintain a sub-stoichiometric ratio for decomposition of the organic molecules.

Preferably, the device for injection is capable of introducing hydrogen into the combustion chamber, transforming the chlorine present in the combustion chamber into hydrochloric acid, in this way minimizing the environmental impact deriving from incomplete transformation of chlorine into hydrochloric acid.

Preferably, the system comprises a control device adapted to monitor and/or modify the combustion parameters to guarantee a combustion temperature between 300 and 600° C., in this way ensuring flameless combustion, adapted to reduce the residues thereof and to maximize molecular decomposition of the incoming material.

Preferably, the means for feeding the material into the system comprise at least one hopper operatively connected to at least one conveyor belt and at least one feed auger, so as to guarantee the correct quantity of material for combustion in the chamber. Even more preferably, the hopper obtains the material through loading from the conveyor belt above and unloads this material from below into the feed auger, which introduces it from above into the combustion chamber.

Preferably, the system comprises means for monitoring the material introduced into the combustion chamber, capable of feeding the combustion chamber in relation to the calorific power of the incoming material, in this way obtaining a maximization of the Syngas production by the combustion chamber.

Preferably, the combustion chamber comprises a first decomposition portion, capable of guaranteeing combustion of the material and production of Syngas from combustion, and a second decomposition portion, operatively connected to the first decomposition portion, capable of incinerating the carbonous residue deriving from the first combustion portion, by subjecting the residue to excess air, in this way obtaining the greatest possible quantity of Syngas and, simultaneously, the smallest quantity of unburned residue in the form of ash.

Preferably, the means for extraction of residues are operatively connected to the combustion chamber. Even more preferably, said means for extraction comprise at least one mesh and/or rake conveyor belt, adapted to convey the combustion residues, operatively connected to at least one extraction auger, adapted to separate the combustion ash.

Preferably, the means for use of the Syngas comprise at least one chamber for oxidation thereof, and means for monitoring oxidation, capable of ensuring the correct air/Syngas and/or oxygen/Syngas ratio.

In a further aspect thereof, the aforesaid objects are achieved by a method for producing "Syngas" from carbon based material, characterized in that it comprises the following steps:

a. introducing said material into a combustion chamber, wherein the combustion chamber has a constant temperature between 300 and 600° C.;
b. residence of said material in said combustion chamber for a time between 5 and 13 hours; said residence time allowing a combustion capable of decomposing the organic molecules of said material producing Syngas, continuously drawn off, and carbonous residues;
c. residence of said carbonous residues at said temperature for a time between 7 and 13 hours with excess air; said excess air being capable of completely incinerating said carbonous residues;
d. use of said Syngas and extraction of the ash produced by said combustion and by said incineration.

Preferably, the Syngas drawn off is conveyed inside a chamber for oxidation and is completely oxidized through forced injection of air and/or oxygen. Even more preferably, oxidation is capable of producing a gas at constant temperature between 1000 and 1200° C.

SUMMARY OF DRAWING

Further characteristics and advantages of the present invention shall be more apparent from the description of preferred embodiments, illustrated by way of non-limiting example in the accompanying FIG. 1, depicting a block diagram relating to the steps of production and use of Syngas through a preferred embodiment of the system according to the present invention.

DESCRIPTION OF BEST AND VARIOUS EMBODIMENTS

With reference to the accompanying FIG. 1, a system 1 for producing Syngas from carbon based material comprises a plurality of means for feeding 10 the material into the system, means for combustion of the material, adapted to produce Syngas, means for use 20 of the Syngas produced and means for extraction of the combustion residues. The means for feeding the material into the system comprise a plurality of hoppers, each operatively connected to a conveyor belt and a feed auger, so as to guarantee the correct quantity of material for combustion in the chamber.

This correct quantity of material for combustion also guarantees continuity of administration of incoming material intended for the production of Syngas. In this way continuous operation of the system is guaranteed, eliminating the need to create batches of material, incoming or between one step and the other.

The means for combustion of the material comprise a sealed combustion chamber maintained constantly in vacuum pressure, with temperature between 300 and 600° C., capable of decomposing the organic molecules of the carbon based material into a mixture of gases and into ash. The combustion chamber is divided into a first decomposition portion 130, capable of guaranteeing combustion of the material in sub-stoichiometric conditions in the absence of air and/or oxygen and production of said Syngas from combustion, and into a second decomposition portion 230, operatively connected to the first decomposition portion 130, capable of incinerating the carbonous residues deriving from the first combustion portion, by subjecting the residue to excess air. Said means for combustion of the material also comprise a device 330 for injection of gas into the combustion chamber. Moreover, the means for combustion of the material comprise a device 320 for monitoring the quantity of gas introduced and to be introduced into the combustion chamber, capable of guaranteeing a correct sub-stoichiometric ratio for decomposition of the organic molecules.

The presence of this device actively contributes to the continuous production of Syngas and therefore to the elimination of batches of materials, incoming and between one step and the next. This is because through this device for monitoring the quantity of gas introduced or to be introduced it is possible to continuously check the state of combustion, thus preventing the material from remaining for too long or for too short a time inside the combustion chamber. In this way, minimizing of pollution is also guaranteed, for example in relation to the discharge, as residues, of unburned material.

The system also provides for a control device adapted to monitor and, if necessary, modify the combustion parameters to guarantee a combustion temperature between 300 and 600° C. Just as the previous device, this device also allows correct combustion, as desired, prevents the material from remaining for too long or for too short a time inside the combustion chamber and minimizes pollution related to emissions and to combustion residues.

The system also comprises means for monitoring the material introduced into the combustion chamber, capable of feeding this latter in relation to the calorific power of this incoming material. This device is useful for guaranteeing the same advantages as the device for monitoring the quantity of gas introduced and to be introduced and as the control device, according to what has already been described.

The means for use 20 of the Syngas produced comprise a plurality of chambers for oxidation thereof and means for monitoring oxidation capable of guaranteeing the correct air to Syngas and if necessary oxygen to Syngas ratio.

Finally, the means for extraction of the residues are operatively connected to the combustion chamber. In particular, these comprise a mesh/rake conveyor belt, adapted to convey the combustion residues to the rotary valve, operatively connected to an extraction auger 220, adapted to separate the combustion ash.

The system 1 operates according to specific steps. The material is introduced into the combustion chambers through a hopper which obtains the material through loading from a conveyor belt above and unloads it, from below, into the feed auger, conveying it from above into the combustion chamber.

Inside the combustion chamber there is a constant temperature between 300 and 600° C., in relation to the material present and the trend, this temperature being monitored and if necessary modified by the combustion control device.

The material introduced remains inside the combustion chambers for a time between 5 and 13 hours. In particular, this residence time is restricted to the first portion 130 of said combustion chambers. In this first portion 130, the residence time produces a flameless combustion capable of decomposing the organic molecules of the carbon based material introduced. This is then decomposed producing Syngas, which is drawn off constantly to be conveyed inside specific means for use of the Syngas. In this first portion, the carbonous residues from the decomposition are also developed.

These latter are conveyed, by means of a moving bed and/or conveyor belt, inside the second portion 230 of the combustion chambers. In said second portion 230, the carbonous residues reside, always at the same monitored temperature, for a time between 7 and 13 hours. During this residence time air is also introduced. This allows complete incineration of the carbonous residue by excess air.

Hydrogen is also introduced into the combustion chambers through a device for injection 330, capable of transforming the chlorine present into hydrochloric acid.

At the end of the residence time firstly inside the first portion 130 and subsequently inside the second portion 230 of the combustion chambers, a gas called Syngas and decomposition residues, consisting of ash, are obtained. These are extracted by means of a mesh/rake conveyor belt, adapted to convey the combustion residues, operatively connected with an extraction auger 220 to the rotary valve, adapted to separate the combustion ash.

Therefore, according to the above description, continuous monitoring of combustion, of the production of Syngas and of the incoming material allows the system 1 according to the present invention to operate continuously without being influenced by production batches. In particular, the production of Syngas is implemented constantly according to demands, avoiding useless production peaks or periods in which no Syngas is produced.

The Syngas produced, drawn off constantly during the whole of the production process, is conveyed inside a chamber for oxidation and is completely oxidized through forced injection of air, or if necessary only of oxygen. Oxidation allows use of the energy carried by the Syngas, producing a gas at constant temperature between 1000 and 1200° C. The use of this gas is therefore made possible by a boiler and/or heat exchanger as is widely known also for normal fossil fuels and described previously.

With the system and the method according to the invention it is possible to accomplish the intended aims and objects.

They allow the implementation of a system and a continuous operating method for producing Syngas from carbon based material which does not require costly and laborious pre-treatment of this incoming material and does not require division of the incoming material into batches, consequently obtaining a product that is not in batches. In particular, it is possible to use materials deriving from waste of any type, comprising biomass materials.

The solution proposed by the present invention also allows the implementation of a system and the use of a method for producing Syngas capable of implementing correct control of the combustion process adapted to allow complete molecular breakdown of the incoming materials and of also controlling continuity of the production process.

Finally, the present solution allows minimizing of residues and ash deriving from the molecular decomposition process. Even more in particular, this minimizing is implemented maximizing the production of Syngas from the material subjected to molecular dissociation.

The invention claimed is:

1. A method for producing "Syngas" from carbon based material in a system comprising means for feeding said material into said system, means for combustion of said material, adapted to produce Syngas, means for use of said Syngas and means for extraction of residues of said combustion, wherein said means for combustion of said material comprise:

a sealed combustion chamber for decomposing the organic molecules of said carbon based material into a mixture of gases and into ash;

a device injecting gas into said combustion chamber;

a device monitoring the quantity of gas introduced or to be introduced into said combustion chamber, for guaranteeing a correct sub-stoichiometric ratio for decomposition of said organic molecules, wherein said method comprises the following steps:

a. introducing said material into the combustion chamber, wherein the combustion chamber has a constant temperature between 300 and 600° C.;

b. maintaining said material in said combustion chamber for a residence time of between 5 and 13 hours, said residence time allowing a combustion capable of decomposing the organic molecules of said material producing Syngas, continuously drawn off, and carbonous residues;

c. maintaining said carbonous residues at said temperature of between 300 and 600° C. for a time between 7 and 13 hours with excess air; said excess air being capable of completely incinerating said carbonous residues; and d. using said Syngas and extraction of the ash produced by said combustion and by said incinerating.

2. The method for producing "Syngas" according to claim 1, wherein said means for use of said Syngas comprise at least one chamber for oxidation of said Syngas and means for monitoring oxidation capable of guaranteeing the correct air/Syngas and/or oxygen/Syngas ratio.

3. The method for producing "Syngas" according to claim 2, wherein said Syngas drawn off is conveyed inside said chamber for oxidation and is completely oxidized through forced injection of air and/or oxygen, said oxidation producing a gas at constant temperature between 1000 and 1200° C.

4. The method for producing "Syngas" according to claim 3, wherein said combustion chamber comprises a first decomposition portion, capable of guaranteeing combustion of said material and production of said Syngas from said combustion, and a second decomposition portion, operatively connected to said first decomposition portion, capable of incinerating the carbonous residue deriving from said first combustion portion, by subjecting said residue to excess air.

5. The method for producing "Syngas" according to claim 4, wherein hydrogen is introduced via said device for injection of gas into said combustion chamber to transform chlorine present in said combustion chamber into hydrochloric acid.

6. The method for producing "Syngas", according to claim 1, wherein said system comprises a control device adapted to monitor and/or modify the parameters of said combustion to guarantee a combustion temperature between 300 and 600° C.

7. The method for producing "Syngas", according to claim 5, wherein said system comprises a control device adapted to monitor and/or modify the parameters of said combustion to guarantee a combustion temperature between 300 and 600° C.

8. The method for producing "Syngas", according to claim 7, wherein said system comprises means for monitoring said incoming material in said combustion chamber, capable of feeding said combustion chamber in relation to the calorific power of said incoming material.

9. The method for producing "Syngas", according to claim 8, wherein said means for feeding said material into said system comprise at least one hopper operatively connected to at least one conveyor belt and at least one feed auger, so as to guarantee the correct quantity of said material for combustion in said chamber; said hopper obtaining said material through loading from above from said conveyor belt and unloading said material from below into said feed auger of said combustion chamber.

10. The method for producing "Syngas", according to claim 9, wherein said means for extraction of the residues are operatively connected to said combustion chamber; said means for extraction comprising at least one rake conveyor belt, adapted to convey said combustion residues, operatively connected to at least one extraction auger, adapted to separate said combustion ash.

* * * * *